US005326230A

United States Patent [19]

Fischer et al.

[11] Patent Number: 5,326,230

[45] Date of Patent: Jul. 5, 1994

[54] CLOSED LOOP CONTROL CIRCUIT FOR VARIABLE HYDRAULIC PUMP

[75] Inventors: Günter Fischer, Gemünden; Rainer Knöll, Burgsinn, both of Fed. Rep. of Germany

[73] Assignee: Mannesmann Rexroth GmbH, Lohr, Fed. Rep. of Germany

[21] Appl. No.: 965,024

[22] Filed: Oct. 23, 1992

[30] Foreign Application Priority Data

Oct. 25, 1991 [DE] Fed. Rep. of Germany ..... 4135277

[51] Int. Cl.[5] ..... F04B 49/00

[52] U.S. Cl. ..... 417/218; 60/445

[58] Field of Search ..... 417/218; 60/445

[56] References Cited

U.S. PATENT DOCUMENTS

| | | | |
|---|---|---|---|
| 3,214,911 | 11/1965 | Kempson | 60/431 |
| 4,065,922 | 1/1978 | Ott et al. | 60/445 |
| 4,129,987 | 12/1978 | Blume | 60/445 |
| 4,244,678 | 1/1981 | Uehara et al. | 417/218 |
| 4,401,182 | 8/1983 | Pollman | 60/445 |
| 4,408,453 | 10/1983 | Westveer | 417/218 |
| 4,710,106 | 12/1987 | Iwata et al. | 417/218 |
| 5,096,926 | 9/1991 | Deininger et al. | 417/218 |
| 5,101,628 | 4/1992 | Yoshino | 60/445 |
| 5,160,295 | 11/1992 | Geringer | 417/218 |

FOREIGN PATENT DOCUMENTS

| | | |
|---|---|---|
| 2413295 | 10/1975 | Fed. Rep. of Germany . |
| 2656056 | 7/1977 | Fed. Rep. of Germany . |
| 3420990 | 12/1983 | Fed. Rep. of Germany . |
| 3410071 | 10/1985 | Fed. Rep. of Germany . |

*Primary Examiner*—Richard A. Bertsch
*Assistant Examiner*—Peter Korytnyk
*Attorney, Agent, or Firm*—Cushman, Darby & Cushman

[57] ABSTRACT

Closed loop control circuit for a variable hydraulic pump the output flow of the pump being variable by control means and the pump including at least two closed loop controllers actuating the control means, wherein at least one hydraulic switching element is provided which automatically connects to the control means the closed loop controller providing the highest or the lowest pressure.

8 Claims, 6 Drawing Sheets

CLOSED LOOP CONTROL CIRCUIT FOR VARIABLE HYDRAULIC PUMP

TECHNICAL FIELD

It has been known for a long time to provide closed loop controls for variable pumps, these controls being in particular pressure controls, flow controls, power controls and combined controls.

BACKGROUND OF THE INVENTION

An output flow/pressure closed loop controller 110 is shown in a circuit diagram in FIG. 6 and is illustrated in detail in FIG. 7 using symbols.

The complete output flow of a pump 111 is herein passed through a variable throttle or orifice. For a fixed position of the throttle 2 the pressure drop at the throttle 2 is proportional to the output flow. Therefore the pressure drop can be considered as being indicative for the output flow. The pressure drop (or differential pressure) acts on the two end faces of a first control spool 4 of an output flow closed loop controller (or output flow control valve) 112.

The control spool 4 has a fixed operating position which is reached when a control opening 6 formed by a control edge a of the spool 4 and a wall b of the bore of the housing is about equal in size as an input flow nozzle 7, i.e. when the edge a of the spool 4 is just opening bore b. By dividing the pressure among the input flow nozzle 7 and the variable output flow opening 6 the pressure acting on the control spool can be equal to the pump pressure (with the opening 6 closed) at the most and at least equal to the reservoir pressure (with the opening 6 completely open).

If in this position of the spool 4 there is an equilibrium of forces, the output flow control operates in the stationary range. If the operating pressure determined by the load 3 is less than the pressure set by a spring 12 of a pressure closed loop controller (pressure control valve) 113 and a valve 15, then a control opening 13 of the pressure control valve 113 is closed and is disregarded in the present contemplation. Now, if, for example, the free cross section of the throttle 2 is made smaller, then, with the present output flow, the pressure drop at the variable throttle 2 is increased and the output flow control spool 4 is moved against the increasing force of a compression spring 5. Thus the control opening 6 increases, the hydraulic oil flows with less resistance to the reservoir, and the pressure at a control piston 9 of the pump 112 decreases.

A control piston 10 opposite the control piston 9 then moves a cam ring 11 of the pump 111 towards smaller displacement until the pressure drop at the variable throttle 2 again corresponds to the biasing of the spring 5. When the load pressure increases, the increasing leakage of the pump 111 is regulated until the second or pressure control spool 14 of the pressure closed loop controller 113 opens the control opening 13. The hydraulic oil now flows in parallel to the control opening 6 to the reservoir and the pressure at the control piston 9 decreases causing the pump 111 to decrease its output flow. The pressure at which the pressure closed loop controller 113 opens the control opening (i.e. the cut-off pressure) is determined by controlling the solenoid operated valve 15.

The use of this output flow/pressure closed loop controller enables the exactly repeatable electrical control of the pressure and the output flow. However, both of the closed loop controllers, i.e. the output flow closed loop controller 111 and the pressure closed loop controller 113, are specially designed. The output flow closed loop controller 111 is superimposed to the pressure closed loop controller 113. Both closed loop controllers 111 and 113 are provided with hydraulic oil via one common nozzle 7.

It is therefore disadvantageous in this known output flow/pressure closed loop controller that special components are required. This is particularly true for the output flow control valve 111 and the pressure control valve 113. A rigid arrangement of the system is provided where no standard components can be used. Further, the prior art output flow closed loop controller 110 is less dynamic than a standard pressure closed loop controller, this being particularly prominent in the control-up being slow.

SUMMARY OF THE INVENTION

The present invention relates to a pressure/output flow closed loop controller (output flow/pressure closed loop controller) enabling the use of standard closed loop controllers which can be manufactured at low cost using mass production techniques.

According to the invention, a hydraulic switching element is provided which connects automatically either a pressure closed loop controller or a output flow closed loop controller (but not both) to a controller means, in particular to a control spool of a variable pump.

Preferably, each closed loop controller is as a standard regulator.

Preferred embodiments of the invention are described in the dependent claims.

BRIEF DESCRIPTION OF THE DRAWINGS

Further advantages, objects and features of the invention will become more apparent to the one skilled in the art upon reading the following detailed description of a preferred embodiment of the invention with reference to the accompanying drawings, in which.

DETAILED DESCRIPTION OF A PREFERRED EMBODIMENT

Figure 1:
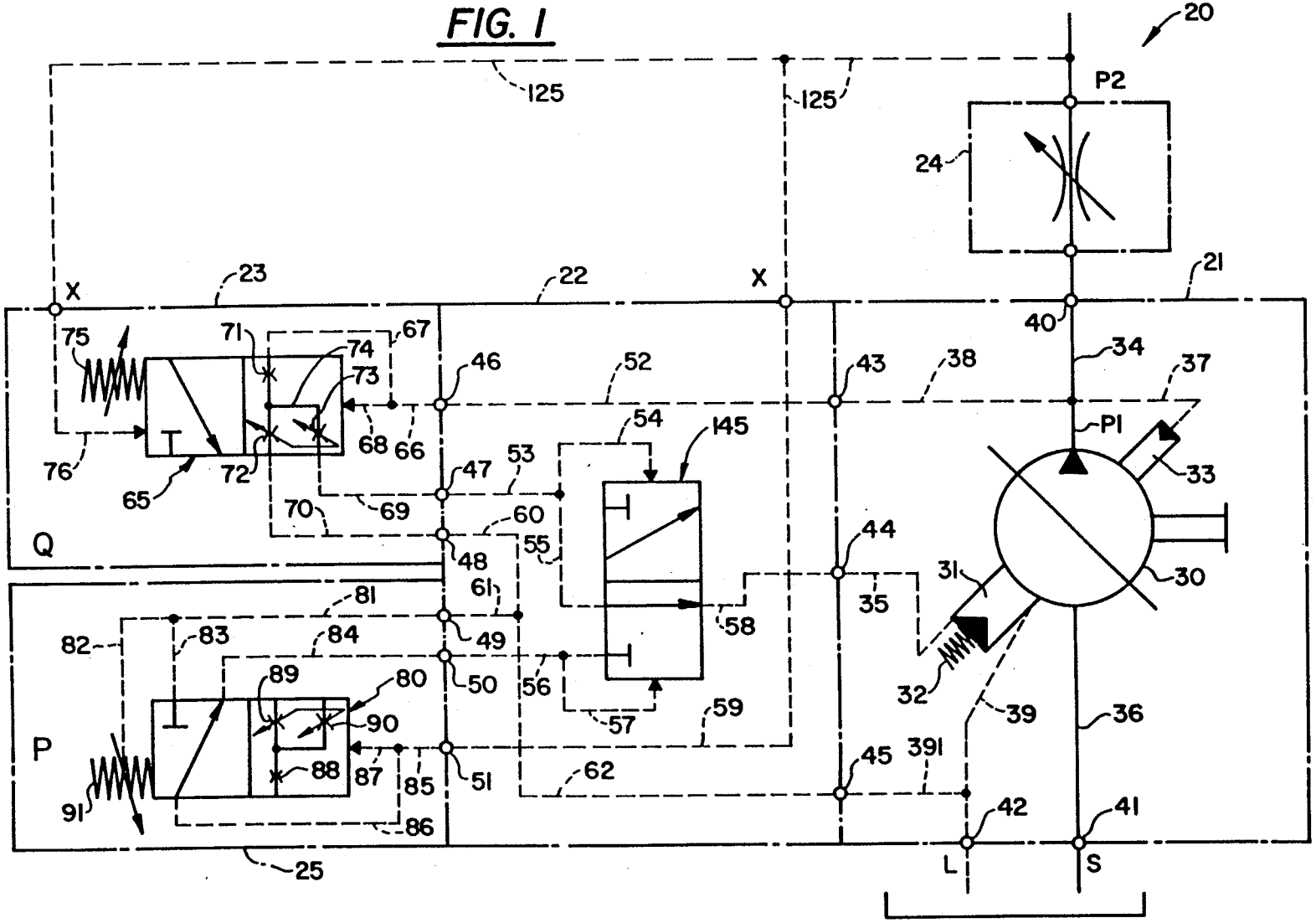
FIG. 1 shows a first embodiment of a pressure/output flow closed loop controller according to the invention using circuit diagram symbols.

A first embodiment of a pressure/output flow closed loop controller is now described with reference to FIGS. 1 and 2. FIG. 1 generally illustrates an arrangement 20 including a pump unit 21 with the pressure/output flow closed loop controller PQ according to the invention. The pressure/output flow closed loop controller PQ essentially comprises a switching valve subplate 22, a variable throttle unit 24, an output flow closed loop controller subplate 23, and a pressure closed loop controller subplate 25 wherein said output flow closed loop controller subplate 23 and said pressure closed loop controller subplate 25 are mounted independently to said switching valve subplate 22.

The pump unit 21 comprises a hydraulic pump 30 with a variable output flow (displacement). The variation of the displacement is achieved by control means 31 acting on the pump 30 and causing the pump 30 to vary the output of pressurized fluid responsive to the information received from the output flow closed loop controller subplate 23 or the pressure closed loop controller subplate 25.

Figure 6:
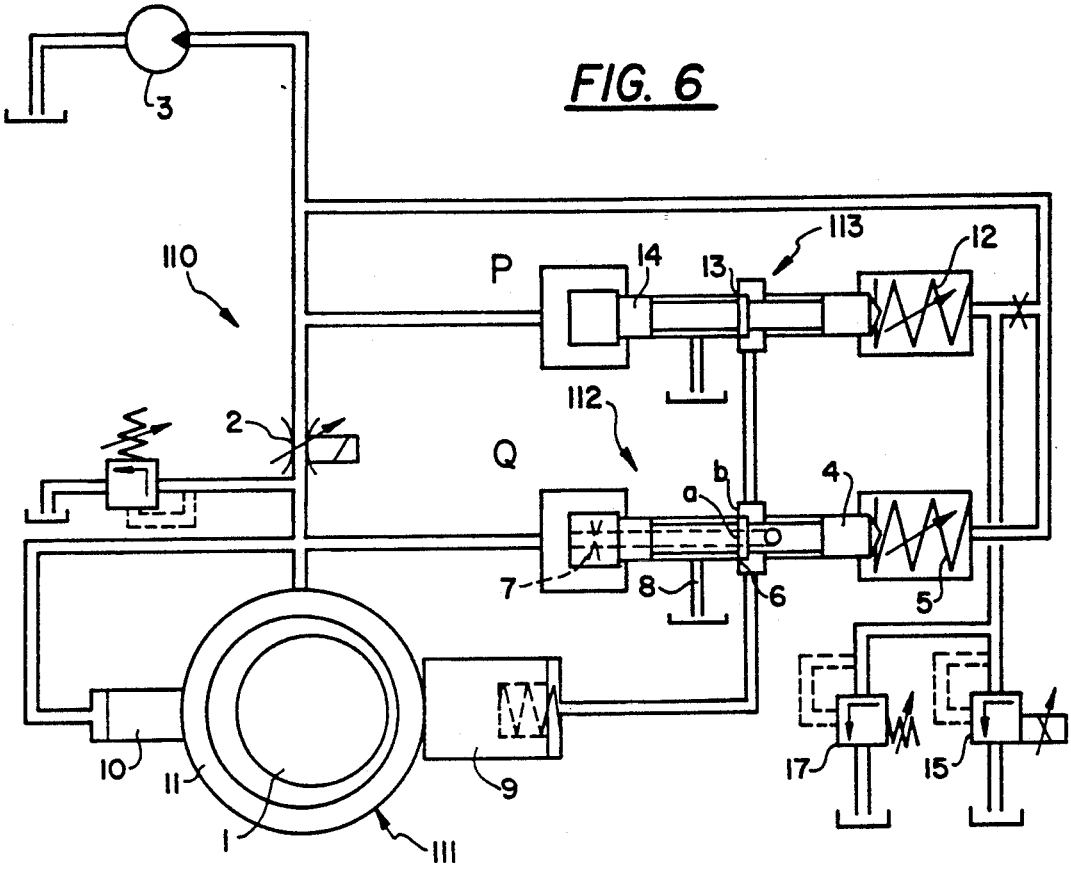
FIG. 6 shows a conventional pressure/output flow closed loop controller as shown in the Mannesmann brochure RD 10491/11.83.

In the illustrated embodiment the control means comprise a first control spool 31 and a second control spool 33 which for example in a vane pump could act on the cam ring 11 as shown in the conventional device of FIG. 6. Further, a spring 32 is provided to bias the first control spool 31 towards a larger displacement of the pump 30. It can be seen that the diameter of the first control spool 31 is larger than the diameter of the second control spool 33. The various ports of the pump unit 21 bear the reference numerals 40 to 45.

The output of the pump 30 is connected to the port 40 via a line 34; the pump pressure referenced P1 and being present in line 34 is applied via control line 37 to the second displacement piston 33 comprising the smaller surface exposed to pressure and is further applied via control line 38 to port 43.

The input of the pump 30 is connected via an intake (or suction) line 36 and port 41 to the reservoir. A further connection of the pump 30 to the reservoir to discharge leakage oil is provided by connection line 39 to port 42 and then to the reservoir. A line section 391 interconnects line 39 with port 45. The first control spool 31 comprising the larger surface exposed to pressure can be exposed to control pressure (control signal) received from the pressure/output flow closed loop controller via a control line 35.

According to the invention, a control pressure is applied to port 44 the control pressure being provided either by the output flow valve subplate 23 or by the pressure closed loop controller subplate 25. The switching valve subplate 22 decides if the output flow valve subplate or the pressure closed loop controller subplate may provide a respective control signal to port 44.

Figure 2:
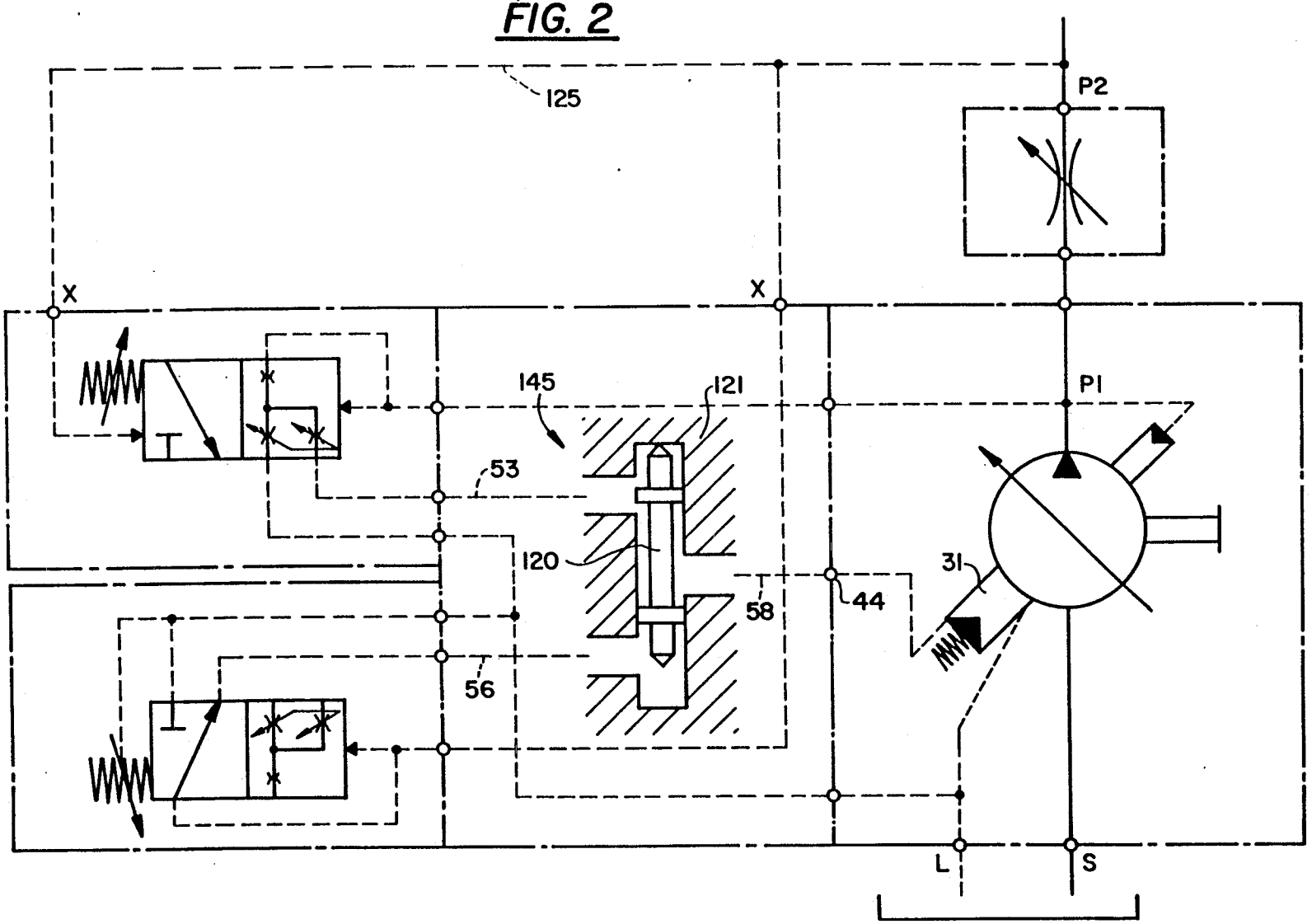
FIG. 2 shows the same illustration as FIG. 1 with an essential element of the invention, namely a switching valve with its switching piston, being shown in detail.

The switching valve subplate 22 primarily includes a switching valve 145 preferably of the type shown in FIG. 2. The switching valve plate 22 comprises in addition to the ports corresponding to the ports 43, 44, and 45 of the pump unit 21 ports 46 to 51 as well as a control port X. In the switching valve subplate 22, an interconnection line connnects ports 46 and 43, and a line 59 connects port 51 and control port X. Further, lines 60, 61, and 62 are provided connecting ports 48 and 45, and 49 and 45, respectively.

In addition to these interconnection lines, the switching valve 145 being a 3/2-way or control valve is connected via line 53 to port 47 and via line 56 to port 50. The line 53 is connected via line 55 to a usage port of valve 145 and is also connected via line 54 to one spool end face (see FIG. 2) of valve 145. Similarly, line 56 being connected to the other usage port is also connected via line 57 to the other spool end face. The output of the valve 145 is connected via line 58 to port 44.

FIG. 2 illustrates a preferred embodiment of the switching valve 145.

A switching spool is reciprocatably mounted in a longitudinal bore in a housing 121 as shown in FIG. 2.

According to the invention, preferably two independently operating closed loop controllers, namely an output flow closed loop controller Q and a pressure closed loop controller P, are provided and are attached to the subplate forming the switching valve subplate.

Figure 5:
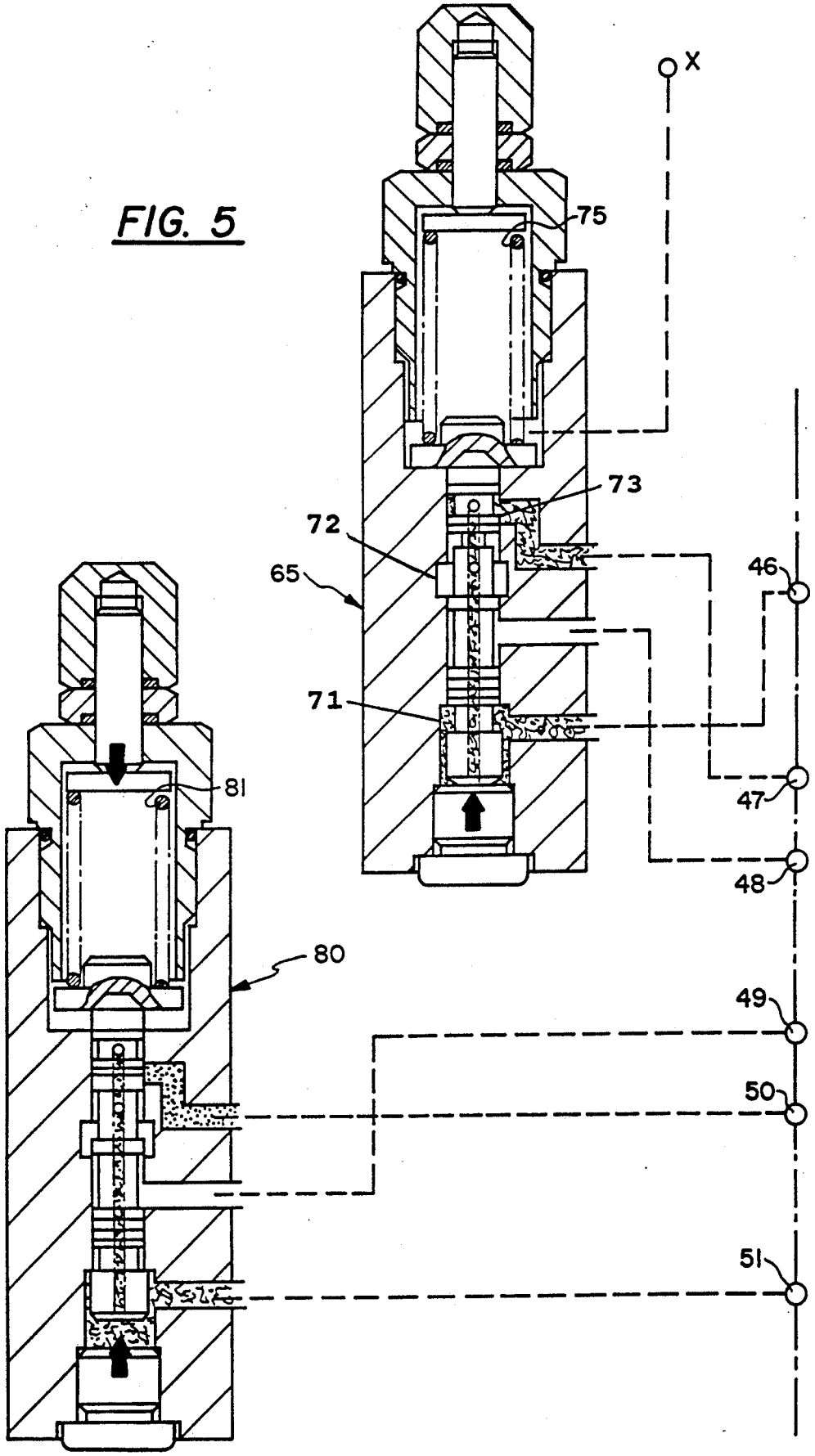
FIG. 5 is a sectional view of a pressure or output flow closed loop controller preferably employed in the first embodiment.

The output flow closed loop controller Q is accommodated in the diplacement closed loop controller subplate 23 comprising a control port X and ports 46, 47, and 48 corresponding to ports of the switching valve subplate 22 and thus being given the same reference numerals. An output flow closed loop controller valve 65 shown in detail in FIG. 5 is similar to a 3/2-valve and has its input connected via lines 66, 67 to the port 46 and is thus in connection with the pump output pressure P1. Via line 68, the output pressure P1 of the pump 30 is further applied to one end face of valve 65 (or spool 120).

On the output side the output flow closed loop control valve 65 is connected via line 69 to port 47 and with its other port via line 70 to port 48. The pressure P2 being applied to control port X is present opposite to the side of the output flow closed loop control valve 65 being exposed to the pressure of the pump, and further an adjustable spring 75 exerts a force.

As can be seen in detail in FIG. 5, the output flow closed loop controller valve 65 forms an intake nozzle 71 and also in series a discharge nozzle 72 variable according to the position of the spool. This arrangement, i.e. the intake nozzle 71 and the discharge nozzle 72 in series, connects the input port of valve 65 with an output port. The second output port is connected via a damping nozzle 73 and an interconnection line 74 with the connection point between the intake nozzle 71 and the discharge nozzle 72. Damping nozzle 73 and discharge nozzle 72 are variable in response to movement of the spool 120 of valve 65.

The output flow closed loop controller valve Q determines in a well known manner the amount of pressurized fluid which is discharged from pump 30 to a load or user (not shown) by determining the differential between the output pressure P1 of the pump and the pressure P2 tapped off or measured behind the variable throttle unit 24. This pressure P2 is applied to the control ports X via lines 125.

The pressure closed loop controller subplate 25 has ports 49, 50, and 51 corresponding to the respective ports on the switching valve subplate 22 which also are referenced accordingly. Further, on the pressure closed loop controller subplate 25, a pressure control valve 80 of the 3/2-valve type is provided. The input port of the valve 80 is connected to port 51 via line 86 and line 85. Also, port 51 is connected via connection lines 85 and 87 to one end face of valve 80 and thus to pressure P2. One output port is connected to port 49 via lines 83, 81, whereas the other output port is connected via line 84 to port 50. Further, port 49 is connected via lines 81 and 82 to the other end face of valve 80. Further, a force generated by an adjustable spring is applied to this end face of valve 80.

Valve 80 further forms a series circuit of an intake nozzle 88 and an outflow nozzle 89. Similarly to the output flow control valve 65 the center tap between the nozzles 88 and 89 is connected via a damping nozzle 90 to the other output port. Both nozzles 89, 90 are variable simultaneously.

FIG. 5 shows the output flow closed loop controller subplate 23 as well as the pressure closed loop controller subplate 25 according to FIG. 1. The same reference numerals were used to denote same parts as in FIGS. 1 and 2.

Figure 7:
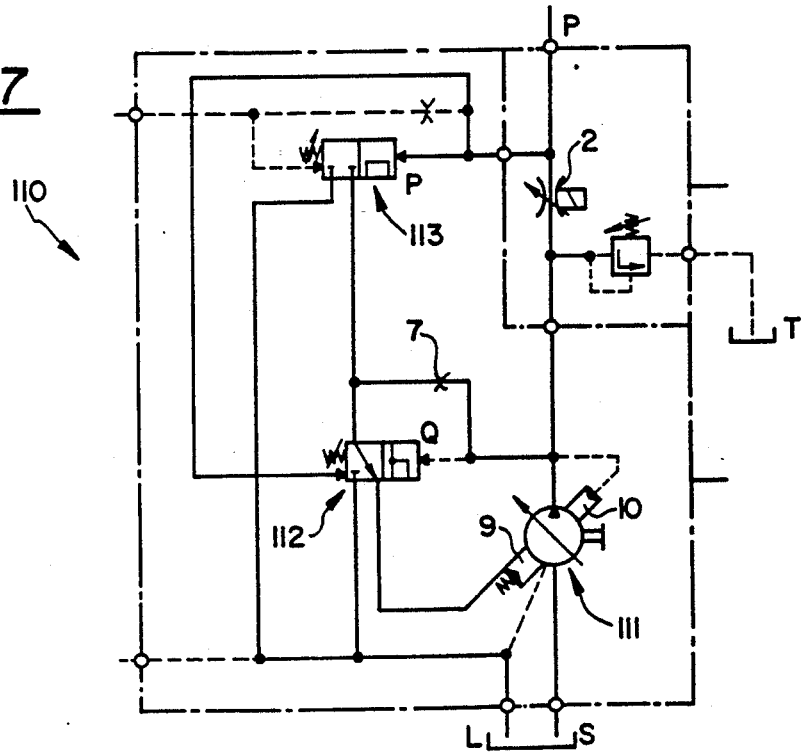
FIG. 7 shows a circuit diagram of the closed loop controller of FIG. 6.

As far as the operation of the pressure/output flow closed loop controller according to FIGS. 1, 2, and 5 is concerned, it is assumed that for one skilled in the art the operation is clear from the above description. For the sake of completeness it may be added that the two closed loop controllers, i.e. the output flow closed loop controller Q and the pressure closed loop controller P operate independently from each other and that they do not influence each other directly as is the case in the prior art and in particular so due to the common nozzle 7 of the prior art of FIGS. 6 and 7. Hence, the properties of the output flow and pressure closed loop controllers which are said to be standard closed loop controllers are maintained.

While the output flow closed loop controller Q provides at its port 47 a control signal as a pressure signal, the pressure closed loop controller P provides a control signal as a pressure signal at its port 50. The switching valve 145 functions to automatically let the lower of the two signals pass and to apply it to the control spool 31 to regulate or control the pump.

Figure 3:
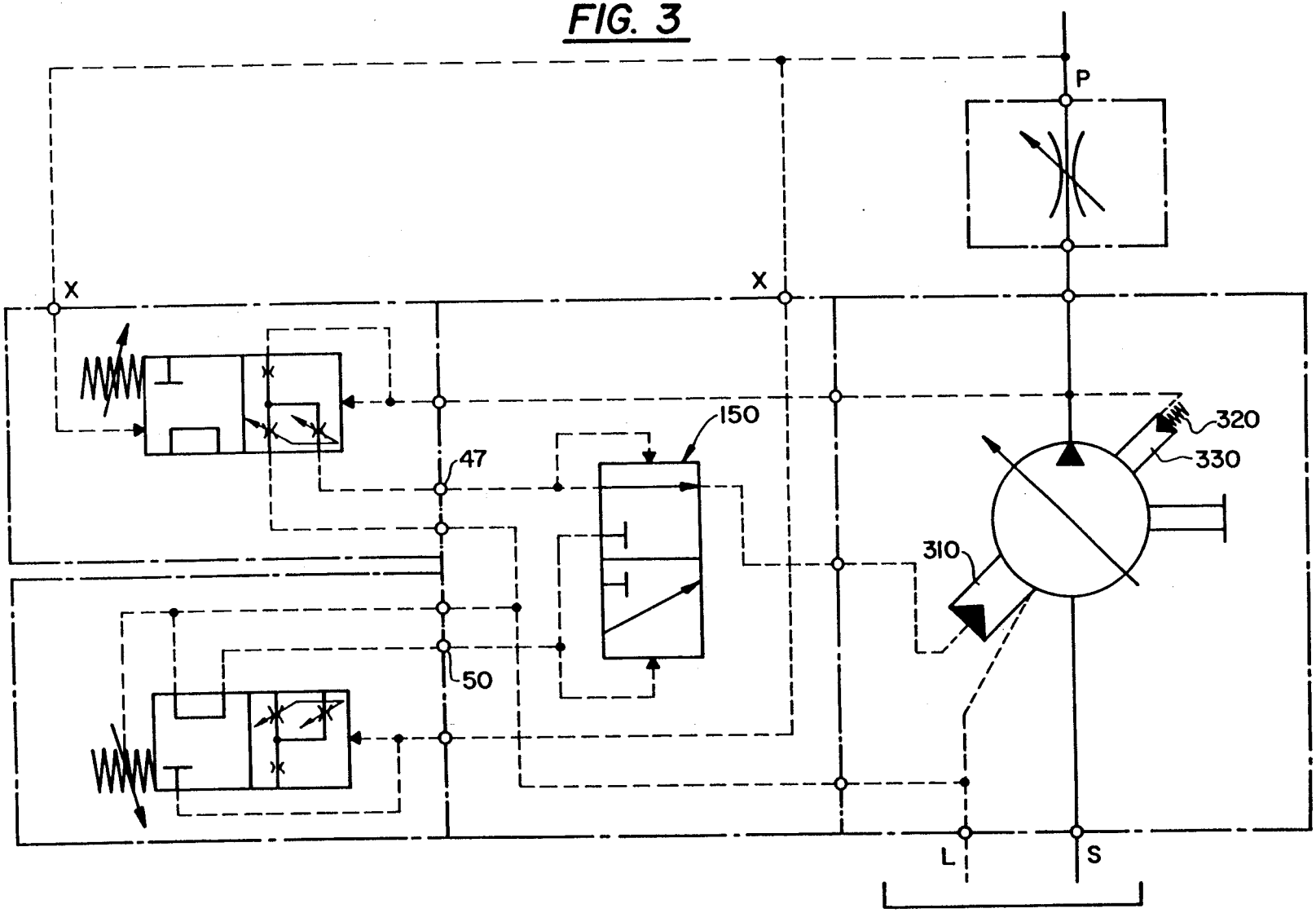
FIG. 3 shows a second embodiment of a pressure/output flow closed loop controller according to the invention, wherein the higher one of the pressures of the pressure closed loop controller and the output flow closed loop controller, respectively, is applied to the control spool via the switching element, rather than the lower one of the two pressures as in FIG. 1.
Figure 4:
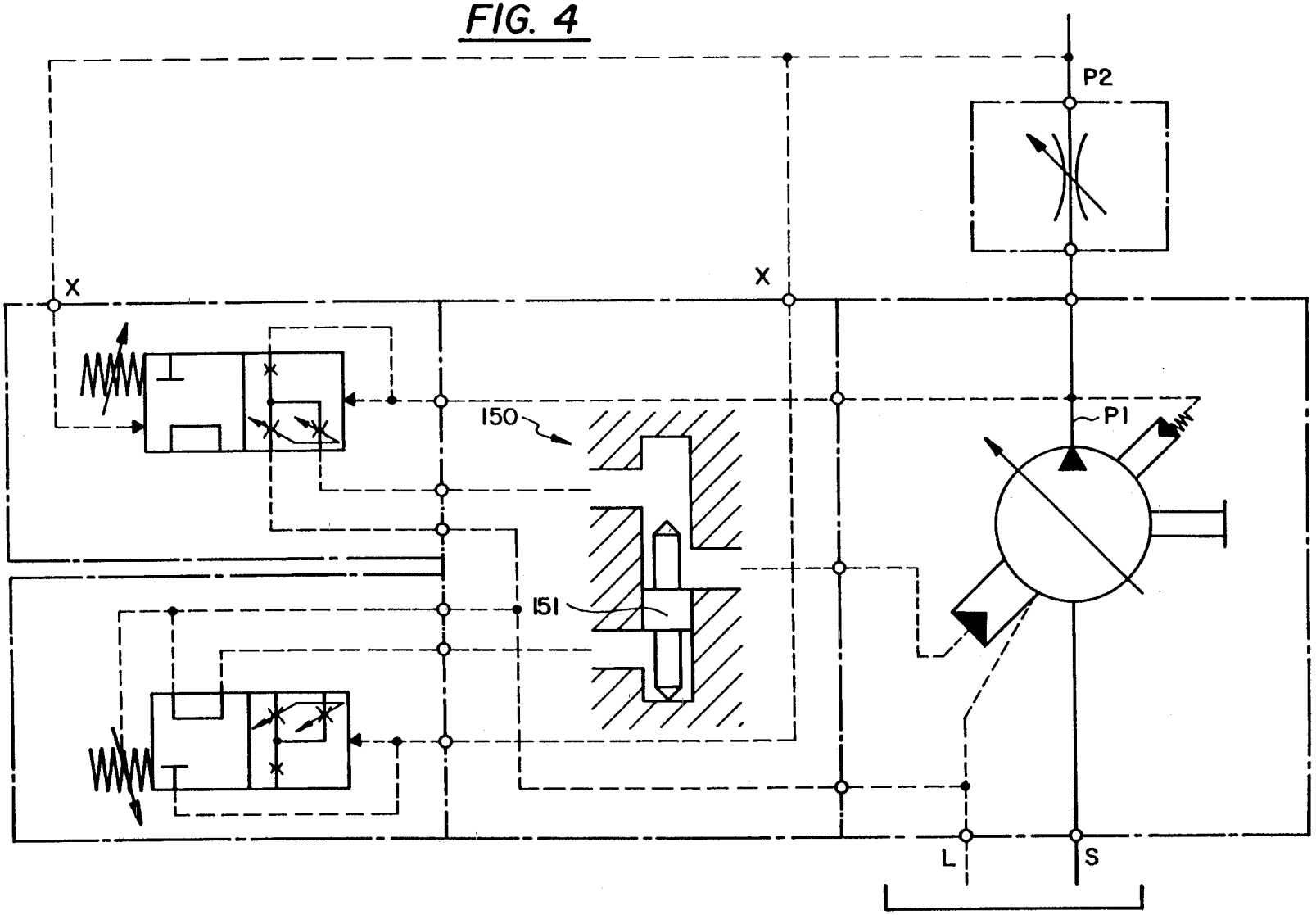
FIG. 4 shows the construction of the switching element in detail similar to FIG. 2 as preferably used for the functional principle of the pressure adding regulation.

FIGS. 3 and 4 illustrate the same functional principle as FIGS. 1 and 2 but for the so-called pressure adding regulation, i.e. the switching valve 150 of FIGS. 3 and 4 selects from the control signal of the output flow closed loop controller Q being applied to port 47 as a pressure signal and the control signal of the pressure closed loop controller P being provided to port 50 as a pressure signal the larger signal and applies said larger signal to the control spool 310 acting against a control spool 330 with a smaller area but being provided with an additional spring.

Otherwise, the embodiment of FIGS. 3 and 4 corresponds to the previous one, i.e. spool 151 of switching valve 150 being—so to speak—complementary. Further, the output flow and pressure control valves are modified as shown in FIGS. 3 and 4. In particular, switching spool 151 could also be a ball.

Further, it is possible to use the output flow and pressure closed loop controllers working independently from each other and thus not influencing each other in any other configuration or application like, for example, several pressure and/or output flow closed loop controllers but always using a switching valve such that only one closed loop controller provides its signal but not both closed loop controllers simultaneously and thereby influencing each other.

We claim:

1. A closed loop control circuit for a variable displacement pump, the output flow of the pump being varied by control means, the control circuit comprising:
   at least two closed loop controllers adapted to actuate the control means by control signals, and
   at least one hydraulic switching valve connected between the closed loop controllers and the control means, wherein the control signals provided by the closed loop controllers are present as pressure signals and the switching valve selects the higher one of said control signals and passes the higher control signal to the control means so as to vary the displacement of the pump.

2. A closed loop control circuit according to claim 1, wherein the switching valve is mounted on a switching valve subplate.

3. A closed loop control circuit according to claim 1, wherein at least two closed loop controllers are mounted on said switching valve subplate.

4. A closed loop control circuit according to claim 1, wherein said switching value includes a valve spool which is moved by the higher pressure into a switching position in which the respective pressure signal is passed on to said control means.

5. A closed loop control circuit for a variable displacement hydraulic pump, the output flow of which being varied by control means, the control circuit comprising:
   at least two closed loop controllers adapted to actuate said control means by control signals, and at least one hydraulic switching valve connected between said closed loop controllers and the control means, wherein the control signals provided by said closed loop controllers are present as pressure signals and the switching valve selects the lower one of said signals and passes the lower control signal on to said control means, so as to vary the displacement of said pump.

6. A closed loop control circuit according to claim 5, wherein the switching valve is mounted on a switching valve subplate.

7. A closed loop control circuit according to claim 5, wherein at least two closed loop controllers are mounted on said switching valve subplate.

8. A closed loop control circuit according to claim 5, wherein said switching valve comprises a valve spool which is moved by the higher pressure into a switching position in which the respective pressure signal is passed on to said control means.

* * * * *